US006221437B1

(12) United States Patent
Reynolds

(10) Patent No.: US 6,221,437 B1
(45) Date of Patent: Apr. 24, 2001

(54) HEATED WORKPIECE HOLDER FOR WET PLATING BATH

(75) Inventor: H. Vincent Reynolds, Marcellus, NY (US)

(73) Assignee: Reynolds Tech Fabricators, Inc., East Syracuse, NY (US)

( * ) Notice: Subject to any disclaimer, the term of this patent is extended or adjusted under 35 U.S.C. 154(b) by 0 days.

(21) Appl. No.: 09/290,912

(22) Filed: Apr. 12, 1999

(51) Int. Cl.[7] ..... B05D 1/18; B05D 3/02; C25D 5/34

(52) U.S. Cl. ..... 427/430.1; 427/314; 427/319; 427/436; 427/437; 427/443.1; 205/148; 205/209

(58) Field of Search ..... 427/314, 319, 427/430.1, 437, 443.1, 436; 205/148, 209; 204/274

(56) References Cited

U.S. PATENT DOCUMENTS

| | | | | |
|---|---|---|---|---|
| 4,507,078 | | 3/1985 | Tam et al. | 432/11 |
| 4,872,835 | | 10/1989 | Tullis et al. | 432/225 |
| 5,025,133 | | 6/1991 | Tsutahara et al. | 219/462 |
| 5,126,533 | | 6/1992 | Newman et al. | 219/385 |
| 5,294,778 | | 3/1994 | Carman et al. | 219/385 |
| 5,437,733 | | 8/1995 | Okumura | 134/34 |
| 5,597,460 | * | 1/1997 | Reynolds | 204/212 |
| 5,635,093 | | 6/1997 | Arena et al. | 219/466 |
| 5,648,006 | | 7/1997 | Min et al. | 219/467 |
| 5,683,564 | * | 11/1997 | Reynolds | 205/68 |
| 5,865,894 | * | 2/1999 | Reynolds | 118/429 |
| 5,904,827 | * | 5/1999 | Reynolds | 205/68 |
| 5,932,077 | * | 8/1999 | Reynolds | 204/224 R |
| 6,042,712 | * | 3/2000 | Mathieu | 205/209 |

FOREIGN PATENT DOCUMENTS 7-286278 * 10/1995 (JP) .

* cited by examiner

*Primary Examiner*—Shrive Beck
*Assistant Examiner*—Michael Barr
(74) *Attorney, Agent, or Firm*—Bernhard P. Molldrem, Jr.

(57) ABSTRACT

A heated platen or chuck is employed in connection with a wet chemistry process cell, such as a plating cell for plating a flat substrate. A flow of electrolyte or other wet process solution is introduced into the cell across the surface of the substrate which is mounted on a the chuck or holder. A cathode ring may be disposed to make electrical contact with the substrate. The cathode ring can include a thin metal thieving ring. A fluid-powered rotary blade or wiper may be employed to draw bubbles or other impurities from the substrate, and a megasonic transducer can apply megasonic acoustic energy to the solution. The cell can be used for electroless or galvanic plating. A heater in the chuck heats the substrate to a temperature significantly above that of the electrolyte. Heating the substrate during plating improves the grain structure of the plated metal.

3 Claims, 2 Drawing Sheets

HEATED WORKPIECE HOLDER FOR WET PLATING BATH

BACKGROUND OF THE INVENTION

This invention relates to wet process plating cells, such as galvanic (for electroplating) or electroless (chemical plating), and is more particularly directed to apparatus and techniques that assist in the plating or wet process treatment of the workpiece to be plated into and from the cell. The invention also concerns a holder or platen that heats the workpiece during a plating operation or other wet-process treatment, which improves the quality of the treated product.

Electroplating plays a significant role in the production of many rather sophisticated technology products, and has recently begun to be used for metallization of semiconductor devices. Recently there has been interest in using plating techniques to form copper conductors on silicon to increase the power or speed of the semiconductor devices. Usually, after copper plating a separate annealing step is used to change the grain structure of the plated material. The separate step requires additional time and additional capital equipment.

A number of techniques for electro-depositing or coating on an article face been described in the patent literature.

A recent technique that employs a laminar flow sparger or injection nozzle within the plating bath is described in my recent U.S. Pat. No. 5,597,460, granted Jan. 28, 1997. The means described there achieve an even, laminar flow across the face of the substrate during the plating operation. A backwash technique carries the sludge and particulate impurities away from the article to be plated, and produces a flat plated article of high tolerance, such as a high-density compact disc master or semiconductor wafer. The techniques in that patent improve the flow regime for the plating solution within the tank or cell, as the flow regime is regarded as being crucial for successful operation. Flow regime is affected by such factors as tank design, fluid movement within the process vessel, distribution of fluid within the vessel and at the zone of introduction of the solution into the vessel, and the uniformity of flow of the fluid as it is contacts and flows across the substrate in the plating cell.

In the plating cell as described in said U.S. Pat. No. 5,597,460, a plating bath contains the electrolyte or plating solution, in which the substrate to be plated is submerged in the solution. A sparger or equivalent injection means introduces the solution into the plating bath and forms a laminar flow of the electrolyte or plating solution across the surface of the substrate to be plated. Adjacent the plating bath is an anode chamber in which anode material is disposed, with the material being contained within an anode basket In a typical optical media or semiconductor electrolytic metallization process, the anode material is in the form of pellets, chunks or nuggets of metal, which are consumed during the plating process. A weir separates the plating bath from the anode chamber, and permits the plating solution to spill over its top edge from the plating bath into the anode chamber. The weir is in the form of a semipermeable barrier that permits metal ions to pass through from the anode chamber into the plating bath, but blocks passage of any particulate matter. A circulation system is coupled to the drain outlet to draw off the solution from the anode chamber, together with any entrained particles, and to feed the solution through a microfilter so that all the particles of microscopic size or greater are removed from the plating solution. Then the filtered solution is returned to the sparger and is re-introduced into the plating cell. In this way a backwash of the plating solution is effected, so that the flow regime of the fluid itself washes any particulates out of the anode chamber in the direction away from the plated article. At the same time, the cleansed and purified solution bathes the plated surface of the substrate as a uniform, laminar flow of solution, thus avoiding high spots or voids during plating. As a result, very high tolerance is achieved, permitting production of compact disc or semiconductor device of extreme density without significant error rates.

The flow regime as described in said U.S. Pat. No. 5,597,460 is further improved by the geometry of the well that forms the tank for the plating bath. In that patent the substrate can be positioned on either a fixed or a conventional rotary mount. A conventional cathodic motor rotates the substrate, e.g. at 45–50 RPM. The substrate can be oriented anywhere from vertical to about 45 degrees from vertical. The well has a cylindrical wall that is coaxial with the axis of the substrate. This arrangement was intended to avoid corners and dead spaces in the plating cell, where either the rotation of the substrate or the flowing movement of the plating solution might otherwise create turbulences.

A U-tube laminar flow sparger, shaped to fit on the lower wall of the plating bath or plating cell, can be positioned adjacent the base of the weir to flow the solution into the space defined between the substrate and the weir. The sparger's flow holes are directed in parallel to create a uniform, laminar flow of the electrolyte across the planar face of the substrate. The axes of the flow holes in the sparger define the flow direction of the plating solution, i.e., generally upwards and parallel to the face of the plated substrate.

An increased evenness in plating is achieved by the technique of my earlier copending application, U.S. patent application Ser. No. 09/020,832, filed Feb. 9, 1998, now U.S. Pat. No. 5,932,077 The disclosure in that patent application is incorporated herein by reference. That technique provides an improvement over the technique described and illustrated in my earlier U.S. Pat. No. 5,683,564. According to that improvement, a rotary blade or wiper is positioned in the plating bath between the semipermeable membrane wall and the substrate, and has an edge disposed a predetermined distance from the planar face of the substrate. This distance can be about one-half inch, and is preferably about three-eighths inch. Preferably, the blade or wiper is pitched in the direction such that the rotating wiper tends to pull the electrolyte, plus any hydrogen bubbles, away from the substrate. The rotary wiper can be fluid powered, and as such can be coupled to the electrolyte return conduit so that the electrolyte itself serves as motive power. The fluid powered wiper can be formed with an annular turbine, mounted in a circular mount therefor that is disposed in the plating bath. A circular opening is in registry with the substrate face that is to be plated. The blade on the annular turbine extends radially inwards. The turbine can have vanes around its periphery, and the circular mount can have an annular recess around which the vanes travel. A conduit from the return conduit to the annular recess supplies fluid to propel the turbine and vane. As the same filtered and conditioned electrolyte that is fed through the sparger into the plating bath is also used to power the turbine, the leakage from this turbine does not in any way contaminate or dilute the electrolyte in the plating bath. The same materials that are used in the walls of the plating cell, e.g., a high quality polypropylene or PFA (Teflon), are also used for the rotary blade, turbine, and mount. The annular turbine can be supported for rotation by rollers (formed of the same or a compatible plastic resin) mounted on the support for the annular turbine. This avoids the need for any bearings or metallic parts. In other possible implementations, a different motor mechanism could be employed to rotate the blade or wiper.

Electroless plating is favored in many applications, and especially in those where there is no electrically conductive layer that could serve as a cathode. Accordingly, electroless plating is now seen as an economical alternative to sputtering or vacuum deposition. This is especially true for metals that are difficult to deposit using sputtering or plasma techniques.

One advantageous approach to electroless plating is disclosed in my earlier patent application, Ser. No. 08/873,154, which was filed Jun. 11, 1997 now U.S. Pat. No. 5,865,894. In that arrangement, a megasonic transducer adjacent the floor of the plating cell applies megasonic energy at a frequency of about 0.2 to 5 MHz to the solution. The frequency can be above 1 MHz, and in some cases above 5 MHz. The megasonic waves distribute the solution evenly on the substrate, and also break up any bubbles or concentrations that may lead to defects in the plated surface.

Where the megasonic plating technique is used for electroplating silicon wafers, the flow regime is further improved by rotating the wafers. This can be achieved by placing the wafers in a carrier or boat and rotating the boat, e.g. at 45–50 RPM. This avoids regions of dead flow within the carrier, and results in uniformity of the metallization thickness and quality.

In order to employ the megasonic plating technique with a stationary substrate, the megasonic transducer and the rotary blade can be incorporated together in a plating cell, as described and illustrated in my U.S. patent application Ser. No. 08/954,239, which was filed on Oct. 20, 1997 now U.S. Pat. No. 5,904,827. The disclosure in these patent application Ser. Nos. 08/873,154 and 08/954,239 are incorporated herein by reference.

The technique described in my application Ser. No. 09/020,832, now U.S. Pat. No. 5,932,077 permits mounting the substrate and lowering the substrate into the plating cell to be automated or robotized. Automation and robotization of the insertion, removal, and transport of the workpiece from one process cell to another have been elusive and have not been realized, making it possible to conduct the entire multiple step plating operation in a clean or super-clean environment. In the technique of that application, the carrier for the substrate is disposed on a sealable door for the plating cell. The door opens to a loading position, which is preferably the horizontal position, and closes to a position which preferably holds the substrate vertically in the plating chamber. The door sealably seats onto an opening in a side wall of the cell. An extendible linear actuator, or other equivalent device, can be employed for moving the door between its open and closed positions. The cell favorably incorporates a controllable drain that opens to drain the solution from the cell so that the same is at a level below the door opening when the door is opened, and which closes to permit the cell to be flooded to the lever of the spillover when the door is in its closed position. For electroplating use, a cathode ring may be disposed at the periphery of the door opening for making electrical contact with the substrate when the door is closed. This cathode ring may include a so-called "thieving ring" that extends radially into contact with the substrate.

To date, the substrate temperature has been governed only by the temperature of the electrolyte, or by the heat generated by the plating action itself. No one has provided a platen that permitted the semiconductor wafer or other substrate to be heated above the temperature of the plating bath.

Some heated platens and chucks have been provided for use in vacuum deposition chambers. A few of the many heated chucks and platens for chemical vapor deposition apparatus are described in U.S. Pat. Nos. 5,294,778; 5,648,006; and 5,635,093. There has been no suggestion to incorporate any of their features or principles into a workpiece holder in a wet chemistry treatment.

OBJECTS AND SUMMARY OF THE INVENTION

Accordingly, it is an object of this invention to provide a heated workpiece holder for a wet plating cell or other wet process cell which achieves increased quality of plated metallization, but without requiring additional process steps after the plating operation.

It is another object of this invention to provide a holder for a plating cell which facilitates insertion and removal of the substrate or other workpiece into and from the plating cell.

It is a further object to provide a plating cell suitable for either galvanic plating or electroless plating, and which can be automated as to the loading or unloading of the workpiece.

According to one aspect of the present invention, a planar face of a substrate is plated with a metal layer. A plating chamber contains an electrolyte or electroless plating system in which the substrate is immersed. A sparger introduces the plating fluid into the plating compartment. A weir or other leveling means permits the plating fluid to spill over from the bath into a second chamber, from which it passes to fluid processing equipment, and then is returned to the sparger. The weir can have a semipermeable membrane wall that permits ions to pass through from the second chamber into said plating chamber, but blocks the flow of the the plating fluid and any entrained particulates. A rotary blade or wiper may be positioned in the plating chamber between the semipermeable membrane wall and the substrate, and where used has an edge disposed a predetermined distance from the planar face of the substrate. Preferably, the blade or wiper is pitched in the direction such that the rotating wiper tends to pull the plating fluid, plus any bubbles or impurities away from the substrate. The rotary wiper is preferably fluid powered. A megasonic transducer can be incorporated in acoustic communication with the plating chamber.

A heated platen or holder serves to carry the workpiece and hold it in position in the liquid within the plating chamber or other wet-process chamber. The holder can be part of a door-type workpiece holder of the type described in my U.S. Pat. No. 5,932,077, or can be part of another arrangement. In this case, the holder may have an aluminum platen on which the workpiece rests, with a heating element positioned within a housing behind the platen. The element can be thermostatically controlled so that the temperature variance over the workpiece is within a fraction of a degree Celsius. A substrate temperature of 200 degrees C. or higher can be maintained while the substrate is immersed in the plating bath or other wet process bath. Maintaining a high temperature during the plating step affects the metal grain structure of the plated material, and reduces the need for annealing after plating. In some cases, the annealing can be entirely omitted.

The heated platen can be employed with other wet-process treatments, such as etching, electoplaning, or other process steps besides plating.

The above and many other objects, features, and advantages of this invention will become more fully appreciated from the ensuing detailed description of a preferred embodiment, which is to be considered in conjunction with the accompanying Drawing.

DETAILED DESCRIPTION OF THE PREFERRED EMBODIMENT

The process flow circuit can be generally configured as shown in my U.S. Pat. No. 5,597,460, which is incorporated herein by reference. As in that arrangement, the plating solution enters via a sparger into a first or plating chamber, backwashes into a second chamber, and exits the second chamber to filters, pumps, and a reservoir, where the plating solution temperature and other parameters are adjusted as necessary. Then the solution is fed back to the sparger.

Figure 1:
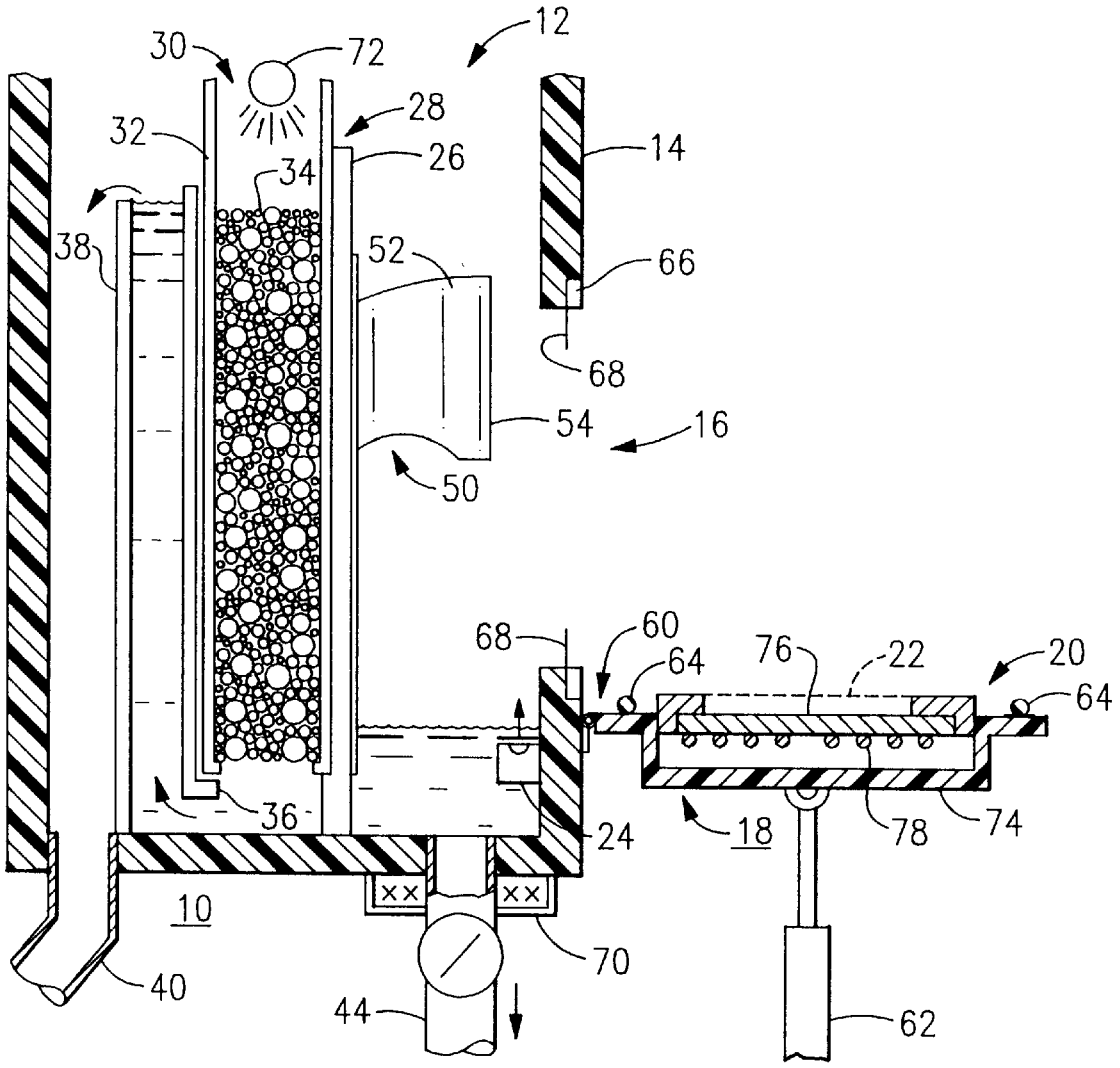
FIG. 1 is a cross sectional elevation of a plating cell according to one preferred embodiment of this invention, showing the holder and door in a horizontal, open position for loading or unloading.

An electroplating cell 10 employing the heated carrier according to an embodiment of this invention is illustrated in FIGS. 1. Here the plating cell 10 is of generally rectangular shape, with a plating or cathode chamber 12 adjacent a vertical front wall 14. The front wall 14 has a circular opening 16 onto which is fitted a hinged door 18. A substrate holder 20 is affixed to a fluid side of the door 18 and holds a substrate 22, here in the form of a silicon wafer on which there are a number of printed masks, and which accepts metallization in the form of printed traces.

A sparger 24 is in the form of a U-shaped member having a series of flow holes for producing a vertical non-turbulent flow of electrolyte. The sparger 24 is disposed at a lower part of the cathode chamber 12 On the side of the chamber 12 away from the door 18 is a weir 26, in the form of a generally vertical wall having a circular opening that is situated generally in registry with the substrate 20. There is a semi-permeable membrane (not shown) across the opening to permit metal ions dissolved in the electrolyte to pass, but which blocks the flow of the liquid electrolyte. At the top edge of the weir 26 is a spillway 28, here of a sawtooth design, which facilitates flow of the electrolyte over the weir 26 into an anode chamber 30. The serrations on the spillway 28 reduce the surface tension drag, both improving the cascading and also minimizing leveling procedures during installation. The anode chamber 30 holds an anode basket 32 containing a fill of metal pellets 34 (e.g., Cu, or other metal) which are consumed during the plating process. The process fluid washes over the pellets in the anode basket 32, and then proceeds around an anode basket locating plate 36 (behind the basket 32). The electrolyte then flows over an anode chamber leveling weir 38, and proceeds out a main process drain 40. The electrolyte thence continues to the equipment within an equipment cabinet, where it is filtered and treated before being returned through the return conduit to the sparger 24. Also shown at the base of the cathode chamber 12 is a cathode chamber dump drain 44. This drain 44 is normally kept closed during a plating process, but is opened after the plating process to empty the cathode chamber.

Also shown in FIG. 1 is a rotary wiper or blade unit 50 fitted against the weir 26. The wiper has a curved blade 52 that extends generally proximally towards the substrate and has a generally linear radial edge 54 that is positioned a short distance from the substrate 22. This distance should be less than one inch, preferably below a half inch, and in this embodiment this distance is about three-eighths inch. The blade 52 can be unitarily formed onto an annular turbine member or ring member. This rotary wiper arrangement is described in detail in U.S. Pat. No. 5,683,564. The blade is curved in relation to the direction of rotation so that it draws fluid away from the substrate 22, that is, in the distal direction, towards the anode.

The door 18 is configured so that it can swing down to an open position for loading, as shown in FIG. 1, or swing up to a closed position. A hinge or pivot 60 is disposed at a lower part of the door, and closing means, e.g., a linear actuator 62 or equivalent door closing means is provided for moving the door between its open and closed positions. An annular seal 64 is positioned on the door 18 to seal against the wall 14. A cathode ring 66 is positioned in a recess on the periphery of the opening 16 so as to contact the substrate 22 when the door 18 is moved to its closed position. A thin metal "thieving" ring 68 is positioned on the cathode ring 66 to contact the periphery of the substrate 22 and absorb some of the unevenness or buildup that is typically found at the outer edge of an electroplated substrate. Alternatively, the cathode ring can be situated on the door 18 as a part of the holder or carrier.

Also shown in this embodiment is a megasonic transducer 70 in acoustic communication with the chamber 12, and generating megasonic energy, e.g. in the range of several hundred kilohertz to several megahertz. Another feature shown here is a sprinkler 72, which sprays fluid into the chamber 30, when the door 18 is in its opened position, at a rate so as to accommodate seepage through the semipermeable membrane in the weir 26.

Between plating operations, the door 18 is lowered to its open or loading position, as shown in FIG. 1, and the substrate 22 is exposed in a horizontal, face-up position. This readies the same to be picked up by a robotic or other automated system and moved to another station. Then a fresh substrate 22 can be moved into position on the holder 20. After this, the door 18 is moved to its closed position, and a plating operation is conducted. During plating, the plating solution is fed through the sparger 24 into the cathode chamber 12, and the latter is kept full so that the fluid spills over the spillway 28 of the weir 26, and continues in the fluid pathway to the anode chamber drain 40. When the plating of the substrate 22 is complete, the electric current is switched off, and the drain 44 is opened to drain the fluid from the cathode chamber 12, down to a level below the base of the door opening 16. At this time there is a minor, but continuous seepage of the solution through the semipermeable membrane in the weir 26. To replace this fluid in the chamber 30, a similar flow of fluid is provided to the sprinkler 72, to maintain fresh solution in the anode chamber at the level of the anode chamber leveling weir 38. Then, when the holder 20 is reloaded and the door 18 is moved to its closed position (FIG. 2) the cathode chamber is again flooded, and the current is switched back on.

Figure 2:
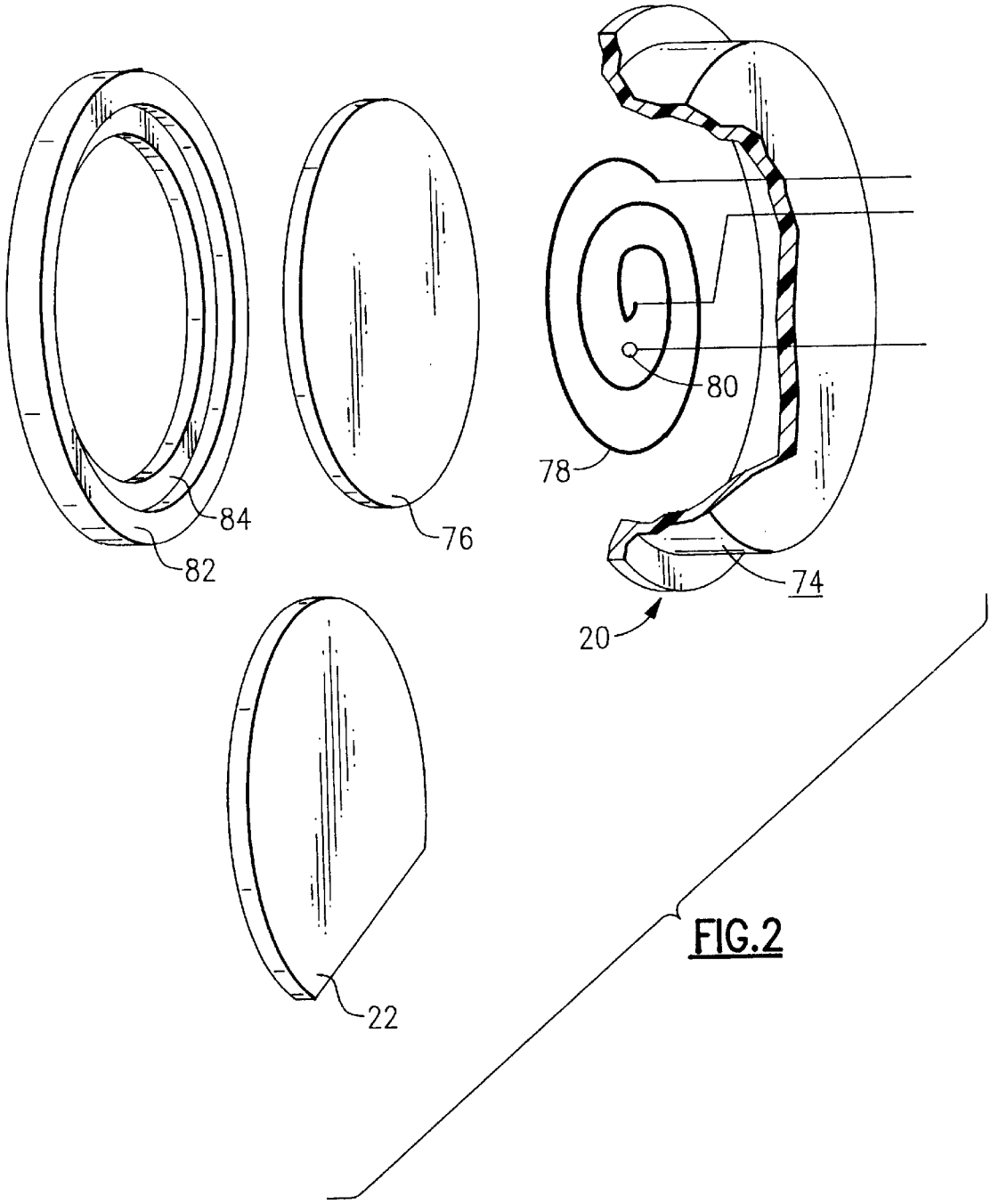
FIG. 2 is an assembly view showing the heated workpiece holder of this embodiment.

FIG. 2 shows detail of the holder 20 which includes means for heating the substrate during a wet process operation. The holder 20 here is shown to have a top-hat shaped cover 74 on which is seated an aluminum plate 76, which serves as the platen of the holder 20. A cavity is defined within the cover 74 in which is positioned a resistive heating coil 78. This is positioned behind and in proximity to the plate 76, so that it heats the plate evenly. Of course, the cavity is sealed so that the heating coil 78 is not contacted by the electrolyte. There are leads connecting the heating coil to a controlled current source (not shown), and a thermal sensor 80 (there may be several of these disposed adjacent the coil 78) is also coupled to control circuitry that is associated with the controlled current source. A hold down element 82 is shown here as a ring for holding the substrate 22 in place on the platen 76. This may carry a contact ring 84 as shown here, or the contact means may be on the periphery of the opening 16, like the cathode ring 68 as shown in FIG. 1.

In the above-described embodiment, the plating cell is set up for a vertically disposed substrate 22. However, the orientation of the holder and substrate is not critical, and can favorably be tilted at a back angle, that is, with the axis of the substrate door and substrate facing slightly upwards. As has been discussed elsewhere, e.g., in U.S. Pat. No. 5,932,077, it is possible to use substantially identical cells for either an electroless plating step or for a galvanic plating step. It is also possible to employ the cells of this embodiment for other intermediate or preparatory steps, such as a megasonic wash/rinse, a chemical etch, etc. The holder 20 and substrate 22 may be disposed horizontally in some applications, either with the substrate facing up or with it facing down.

The heating element 78 heats the platen 76 evenly, i.e., to within one degree C. across its diameter, and favorably within a few tenths of a degree C. In many applications, the platen 76 and substrate 78 are elevated to 200 degrees C. or above to enhance the quality of the plated metallization. It is also possible to provide a controlled temperature gradient across the surface of the substrate, if that is desired. The grain size of the plated metal can be increased above what is laid down on an unheated substrate. In many cases, a subsequent annealing step is unnecessary.

The heated carrier 20 can be used to advantage with other metals besides copper, and can be used with electroless plating systems.

While the invention has been described with reference to a preferred embodiment, it should be recognized that the invention is not limited to that precise embodiment, or to the variations herein described. Rather, many modifications and variations would present themselves to persons skilled in the art without departing from the scope and spirit of the invention, as defined in the appended claims.

I claim:

1. A process of plating a planar face of a substrate with a metal layer in an plating cell having a plating compartment that contains an plating solution in which the planar face of said substrate is immersed, sparger means introduces said plating solution into said plating compartment, drain outlet means carry plating solution and any entrained particulate matter from the plating compartment, means coupled between the drain outlet and the sparger means conditions and returns the solution through a return conduit to said sparger means; and a holder for said substrate includes a platen on which said substrate rests and a heater element behind said platen controllably heats said platen and said substrate; the process comprising the steps of: mounting said substrate onto said holder; introducing said plating solution through said sparger means into said compartment to fill the plating compartment and create a flow of said solution across said planar face; controllably heating said platen and the entire substrate to a temperature significantly above the temperature of said plating solution to an elevated temperature high enough to affect the grain structure of the plated metal layer; and after said substrate has been sufficiently plated, removing the substrate from said holder.

2. The process of claim 1 wherein said elevated temperature is 200 degrees C. or above.

3. The process of claim 1 wherein said platen is heated uniformly across the diameter of the substrate.

* * * * *